US009243839B2

(12) United States Patent
Kim et al.

(10) Patent No.: US 9,243,839 B2
(45) Date of Patent: Jan. 26, 2016

(54) REFRIGERATOR

(71) Applicant: LG ELECTRONICS INC., Seoul (KR)

(72) Inventors: Taegyeong Kim, Seoul (KR); Ayoung Choo, Seoul (KR); Myeongha Yi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/660,675

(22) Filed: Mar. 17, 2015

(65) Prior Publication Data

US 2015/0300728 A1 Oct. 22, 2015

(30) Foreign Application Priority Data

Apr. 16, 2014 (KR) ..... 10-2014-0045317

(51) Int. Cl.
*F25D 25/02* (2006.01)
*F25D 23/00* (2006.01)
*A47B 57/06* (2006.01)

(52) U.S. Cl.
CPC ..... *F25D 25/024* (2013.01); *F25D 23/00* (2013.01); *F25D 25/02* (2013.01); *A47B 57/06* (2013.01)

(58) Field of Classification Search
CPC ..... F25D 25/00; F25D 25/02; F25D 25/021; F25D 25/024; F25D 25/04; A47B 57/06; A47B 57/08; A47B 57/10; A47B 57/20; A47B 57/22; A47B 57/26; A47B 57/265; A47B 57/30; A47B 57/32; A47B 57/34; A47B 57/36; A47B 57/38; A47B 57/48; A47B 57/482; A47B 57/485; A47B 57/487; A47B 57/54; A47B 57/545; A47B 57/12; A47B 57/14
See application file for complete search history.

(56) References Cited

U.S. PATENT DOCUMENTS 2,998,290 A * 8/1961 Sharpe ..... 312/303
3,316,044 A * 4/1967 Carbary ..... 312/408
(Continued)

FOREIGN PATENT DOCUMENTS

CN 102494508 A * 6/2012 ..... F25D 25/02
EP 1 621 838 A2 2/2006
(Continued)

OTHER PUBLICATIONS

European Search Report dated Sep. 30, 2015 issued in Application No. 15163436.7.
(Continued)

*Primary Examiner* — Andrew Roersma
(74) *Attorney, Agent, or Firm* — Ked & Associates, LLP

(57) ABSTRACT

A refrigerator includes a cabinet with a storage chamber, and a shelf assembly vertically movably mounted in the storage chamber. The shelf assembly includes a pair of guide members mounted to opposite side walls of the storage chamber, a shelf guided by the guide members to be vertically movable, a pair of side walls extending downwards from opposite lateral ends of the shelf and vertically movable while being guided by the guide members, a handle member having opposite ends mounted in guide slots formed through upper portions of the side walls, to be slidably guided by the guide slots in forward and rearward directions, two pairs of cam members pivotably mounted to the corresponding guide members, to support the shelf, and a pair of extension portions pivotally connected to the corresponding cam members while extending rearwards from opposite ends of the handle member.

19 Claims, 6 Drawing Sheets

(56) References Cited

U.S. PATENT DOCUMENTS

| | | | | |
|---|---|---|---|---|
| 3,666,342 | A * | 5/1972 | Biesecker | 312/333 |
| 3,809,450 | A * | 5/1974 | Guth | 312/351 |
| 8,297,726 | B2 * | 10/2012 | Ramm et al. | 312/408 |
| 8,376,482 | B2 * | 2/2013 | An et al. | 312/408 |
| 2005/0062380 | A1 | 3/2005 | Park et al. | |
| 2009/0058247 | A1 | 3/2009 | Collins et al. | |
| 2011/0031863 | A1 * | 2/2011 | Benitsch et al. | 312/408 |
| 2013/0081421 | A1 * | 4/2013 | Kwon et al. | 62/440 |
| 2015/0076985 | A1 * | 3/2015 | Yoo et al. | 312/408 |

FOREIGN PATENT DOCUMENTS

| | | | | | |
|---|---|---|---|---|---|
| JP | 2002174487 | A * | 6/2002 | | F25D 25/02 |
| JP | 2002-264943 | A | 9/2002 | | |
| JP | 2004298218 | A * | 10/2004 | | A47B 51/00 |
| KR | 10-2006-0040290 | A | 5/2006 | | |
| KR | 20-2009-0012064 | A | 11/2009 | | |
| KR | 10-2009-0129076 | A | 12/2009 | | |
| KR | 10-1035144 | B1 | 5/2011 | | |
| KR | 20-0468206 | Y1 | 8/2013 | | |
| WO | WO 2013/041679 | A2 | 3/2013 | | |

OTHER PUBLICATIONS

European Search Report dated Sep. 8, 2015 issued in Application No. 151630506.6.

* cited by examiner

REFRIGERATOR

CROSS-REFERENCE TO RELATED APPLICATION

This application claims priority under 35 U.S.C. §119 to Korean Patent Application No. 10-2014-0045317, filed on Apr. 16, 2014, whose entire disclosure is hereby incorporated by reference.

BACKGROUND

1. Field

The present disclosure relates to a refrigerator, and more particularly to a refrigerator capable of easily moving a shelf mounted to a storage chamber without separation of the shelf.

2. Background

Generally, a refrigerator is an appliance for storing food, etc. within a storage chamber in a frozen or refrigerated state by discharging, into the storage chamber, cold air generated through a refrigeration cycle constituted by a compressor, a condenser, an expansion valve, an evaporator, etc. Such a refrigerator generally includes a freezing compartment for storing food or beverages in a frozen state, and a refrigerating compartment for storing food or beverages at low temperature. A Kimchi refrigerator, which stores food such as Kimchi or vegetables in a fresh state, is another form of refrigerator.

At least one of plural doors installed at a refrigerator is connected to one side of a body by a hinge, to open or close a front side of the body through pivotal movement thereof. In addition to such a door, which pivots about a hinge, a drawer type door may also be employed. The drawer type door includes a drawer, and a door mounted to a front side of the drawer, to be withdrawn or retracted in a forward or rearward direction, together with the drawer.

Generally, storage compartments of a refrigerator, namely, freezing and refrigerating compartments, are provided with a plurality of shelves to vertically divide the freezing and refrigerating compartments into sections, in order to store food articles having various sizes and to enhance space utilization. Since food articles to be placed on such shelves may have various sizes, the shelves are separably mounted at different levels in the freezing and refrigerating compartments while being movable to adjust mounting levels thereof.

Mounting of the shelves may be achieved by slidably mounting the shelves to a plurality of support ribs formed at left and right surfaces of the refrigerating and freezing compartments, or coupling a pair of cantilevers coupled to each shelf, and then mounting the cantilevers to mounting rails each formed with a plurality of vertically arranged holes.

In accordance with such related art, however, level adjustment of shelves may be difficult and troublesome because, when it is desired to adjust mounting level of a shelf, the user has to separate the shelf from the support ribs or mounting rails after completely removing food articles from the shelf, and then to mount the separated shelf to another level.

In this regard, the applicant proposed a structure capable of adjusting the level of a shelf while food is placed thereon, as disclosed in Korean Unexamined Patent Publication No. 10-2006-0040290. However, the disclosed conventional structure has a problem in that, when it is desired to adjust the level of a shelf, the user has to move the shelf along an inclined guide slot in forward and rearward directions by a long distance. Furthermore, the shelf should be moved between an initial position and a final position by a considerable distance. In addition, there may be a danger in that, when the shelf is used under a condition that the shelf is disposed at an upper position thereof, and food articles are placed on the shelf, the shelf may be moved to a lower position thereof along the guide slot.

BRIEF DESCRIPTION OF THE DRAWINGS

The embodiments will be described in detail with reference to the following drawings in which like reference numerals refer to like elements wherein.

DETAILED DESCRIPTION

Figure 1:
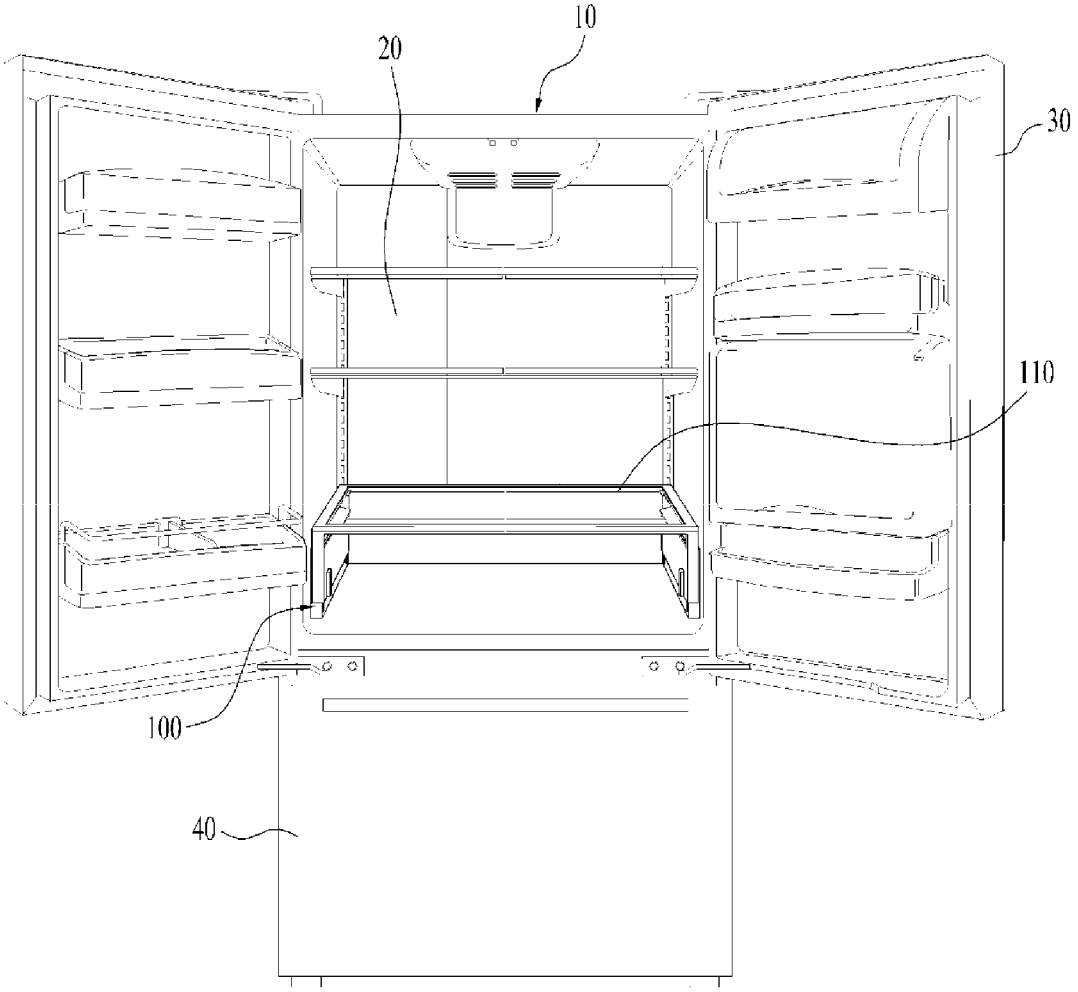
FIG. 1 is a perspective view illustrating a bottom freezer type refrigerator equipped with a shelf assembly in accordance with the present disclosure.

FIG. 1 is a perspective view illustrating a bottom freezer type refrigerator equipped with a shelf assembly in accordance with the present disclosure. The refrigerator includes a cabinet 10 defined with a storage chamber therein, and a shelf assembly 100 mounted in the storage chamber, to be vertically movable. The shelf mounted on the shelf assembly 100 may be supported by cantilevers. Otherwise, this shelf may be supported by shelf support ribs.

The illustrated refrigerator is a bottom freezer type refrigerator in which a refrigerating compartment 20 is provided at a top side of the cabinet 10, and a freezing compartment is provided at a bottom side of the cabinet 10. However, the present disclosure may also be applied to refrigerators of other types, so long as the shelf assembly 100 is mountable in a storage chamber such as a refrigerating compartment or a freezing compartment.

Refrigerators of other types include a side-by-side type refrigerator in which a freezing compartment and a refrigerating compartment are laterally arranged, and a top mounting type refrigerator in which a freezing compartment is arranged over a refrigerating compartment. In addition, the present disclosure may be applied to a refrigerator including a refrigerating compartment or a freezing compartment alone, so long as the shelf assembly 100 is mountable in the storage chamber.

The shelf assembly 100 may mainly be mounted in a refrigerating compartment, but may be mounted to a freezing compartment. In the following description, the storage chamber may mean a refrigerating compartment or a freezing compartment. In this regard, the shelf assembly 100 of the present disclosure may be mounted in a refrigerating compartment or a freezing compartment.

The refrigerating compartment 20 provided at the top side of the cabinet 10 may be opened or closed by a pair of pivotally-mounted refrigerating compartment doors 30. The freezing compartment provided at the bottom side of the cabinet 10 may be opened or closed by a freezing compartment door 40, which is a drawer type door. Of course, the freezing compartment door 40 may be a pivotally-mounted door, in place of the drawer type door.

The shelf assembly 100 may mainly be mounted in a lower portion of the refrigerating compartment 20, and may include a vertically movable shelf. The shelf assembly 100 may further include at least one shelf separably mounted on the shelf assembly 100.

Figure 2:
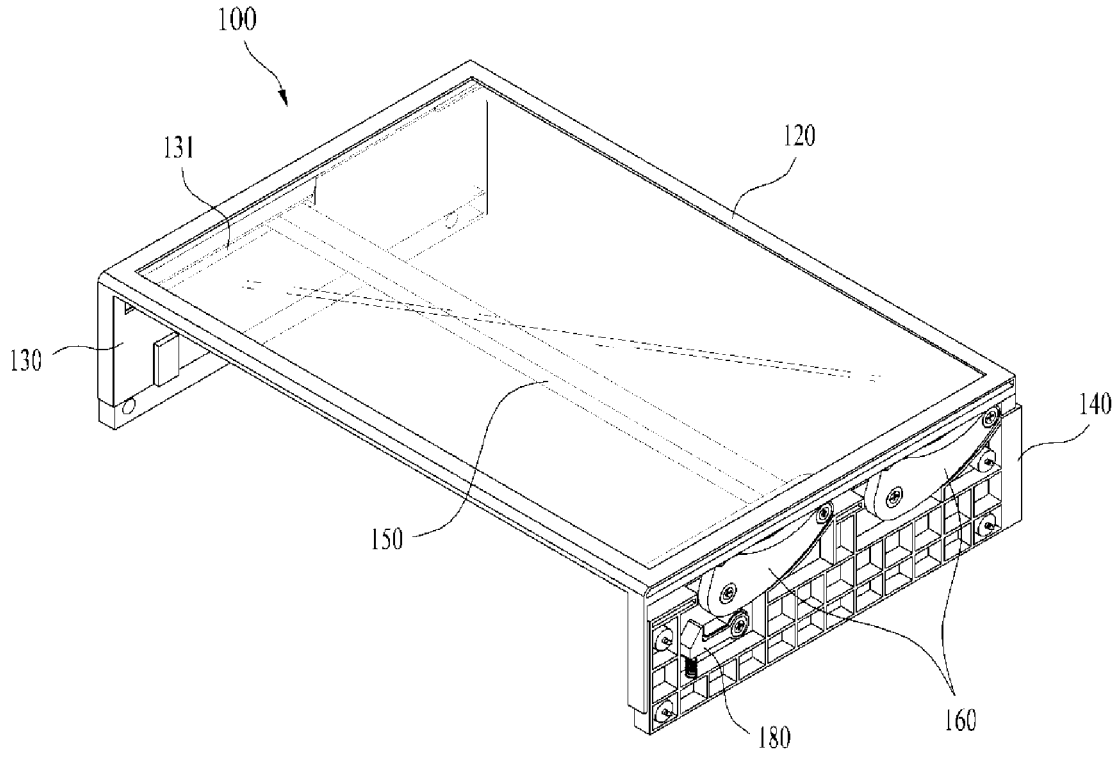
FIG. 2 is a perspective view illustrating a shelf assembly according to a preferred embodiment of the present disclosure.
Figure 3:
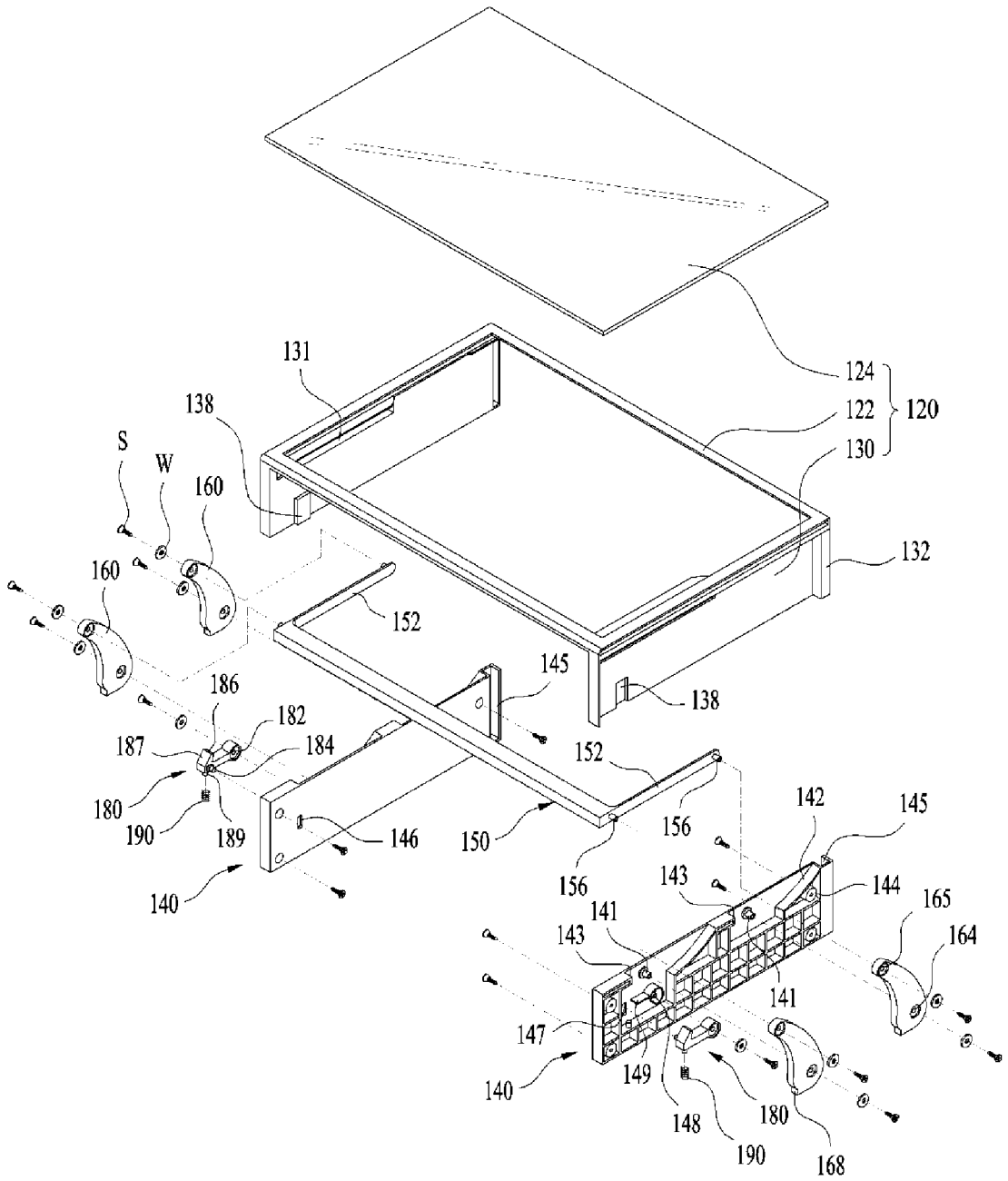
FIG. 3 is an exploded perspective view illustrating an exploded state of the shelf assembly illustrated in FIG. 2.

FIG. 2 is a perspective view illustrating a shelf assembly according to a preferred embodiment of the present disclosure. FIG. 3 is an exploded perspective view illustrating an exploded state of the shelf assembly illustrated in FIG. 2.

The shelf assembly 100 according to the illustrated embodiment of the present disclosure may include a pair of guide members 140 respectively mounted to opposite side walls of the storage chamber, a shelf 120 vertically movable while being guided by the guide members 140, a pair of side walls 130 extending downwards from opposite lateral ends of the shelf 120 and vertically movable while being guided by the guide members 140, respectively, and a handle member 150 extending laterally through a pair of guide slots 131 formed through upper portions of the side walls 130 while extending in forward and rearward directions, to be slidably guided by the guide slots 131 in forward and rearward directions.

The shelf assembly 100 may also include two pairs of cam members 160 pivotably mounted to corresponding ones of the guide members 140, to vertically move the shelf 120, and a pair of extension portions 152 pivotally connected to corresponding ones of the cam members 160 while extending rearwards from opposite ends of the handle member 150, respectively.

Each guide member 140 has a plate shape having a predetermined thickness. Each guide member 140 may be fastened to an inner side surface of the refrigerating compartment 20 by fasteners such as screws S, to be coupled to the refrigerating compartment 20. Fastening holes 144 are formed through each guide member 140 at plural positions, respectively, as illustrated in FIG. 3. Each guide member 140 may mainly be made of a plastic material. A plurality of reinforcing ribs are formed at an outer surface of each guide member 140 and, as such, the guide member 140 may have sufficient support strength while having a relatively small thickness.

The shelf 120 is supported by the guide members 140, to be vertically slidable. The shelf 120 may have a flat plate shape, and may include the pair of side walls 130, which extend downwards from opposite lateral ends of the shelf 120 and are vertically movable while being guided by the guide members 140, respectively.

The shelf 120 may include a peripheral portion 122 formed to be integrated with the side walls 130, and a shelf portion 124 mounted to the peripheral portion 122 inside the peripheral portion 122 and made of a transparent material. The side walls 130 are formed to be linearly symmetrical. Each side wall 130 may be provided with one guide slot 131 formed through the upper portion of the side wall 130 while extending in forward and rearward directions.

The handle member 150 extends laterally through the guide slots 131, to be slidably guided by the guide slots 131 in forward and rearward directions. Since the space defined beneath the shelf 120 may be used as an article receiving space when the shelf 120 is positioned at a raised position, it is desirable to mount the handle member 150 at a position as high as possible on the side walls 130. To this end, the guide slots 131, in which the handle member 150 is mounted, are formed at positions close to uppermost portions of the side walls 130, respectively.

The two pairs of cam members 160 are pivotably mounted to respective outer surfaces of the corresponding guide members 140. Two recesses are provided at the outer surface of each guide member 140 and, as such, two cam members 160 of the corresponding cam member pair are pivotally mountable in the recesses, respectively. Two pivotal pins 141 are provided at respective recesses and, as such, the corresponding cam members 160 are mounted to respective pivotal pins 141.

The two extension portions 152 extend rearwards from opposite ends of the handle member 150 protruding outwards from the guide slots 131 while extending through the guide slots 131, and are pivotably connected to respective pairs of the cam members 160. Pivotal pins 156 may be formed at front and rear portions of an outer surface of each extension portion 152, respectively, to protrude outwards.

Portions of the handle member 150 adjacent to opposite ends of the handle member 150 are slidably supported by respective guide slots 131. The extension portions 152 are movable in forward and rearward directions outside the side walls 130, respectively. Each guide slot 131 is formed at a front portion of the corresponding side wall 130, to extend in forward and rearward directions. Front and rear ends of the guide slot 131 function as stoppers to limit front and rear positions of the handle member 150, respectively.

Each cam member 160 may include a first pin hole 164 formed at a portion of the cam member 160 adjacent to one end of the cam member 160, to receive a corresponding one of the pivotal pins 141 of the corresponding guide member 140, and a second pin hole 165 formed at the other end of the cam member 160, to receive a corresponding one of the pivotal pins 156 of the corresponding extension portion 152.

Each cam member 160 may have a streamlined shape curved in one direction with respect to the first pin hole 164 and second pin hole 165 thereof. Accordingly, the cam member 160 may be formed with a convex surface at one side thereof while being formed with a concave surface at the other side thereof.

An outer peripheral surface of the cam member 160 around the second pin hole 165 pushes the shelf 120 upwards while pivotally moving under the condition that the outer peripheral surface contacts a lower surface of the shelf 120 and, as such, the outer peripheral surface preferably takes the form of an arc surface extending through an angle of at least 180° about the second pin hole 165.

Each pivotal pin 141 formed at the outer surface of each guide member 140 may take the form of a boss formed with a screw hole, to fasten the corresponding cam member 160 thereto, using a screw S. Each cam member 160 should be pivotably mounted to the corresponding pivotal pin 141 and, as such, a washer W made of a material exhibiting low friction is fitted between the cam member 160 and the screw S upon fastening the cam member 160. Similarly to each pivotal pin 141, each pivotal pin 156 of the extension portions 152 may take the form of a boss formed with a screw hole, and may be fastened to the corresponding second pin hole 165 of the cam members 160, using a washer W and a screw S.

Each guide member 140 may include a first support portion 142 provided at an outer surface of the guide member 140, to support a corresponding one of the cam members 160 in the guide member 140 when the corresponding cam member 160 is positioned at a lowered position thereof, and a second support portion 143 provided at the outer surface of the guide member 140, to support the corresponding cam member 160 when the corresponding cam member 160 is positioned at a raised position thereof.

The first support member 142 may be provided at a rear lower portion of a corresponding one of the recesses formed at the guide member 140, and may take the form of a curved surface inclined forwards. The second support member 143 may take the form of a rib extending horizontally at a front portion of the corresponding recess.

Figure 5:
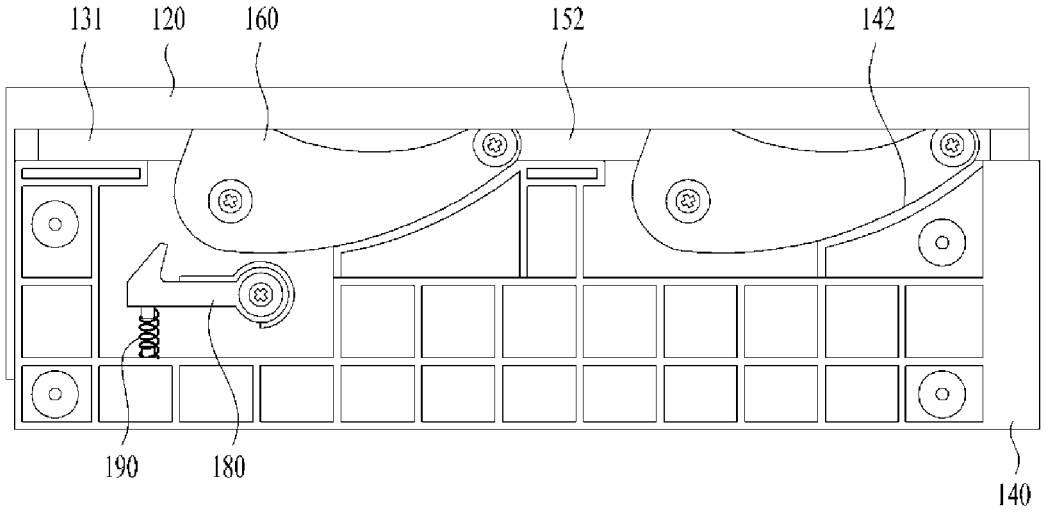
FIG. 5 is a right side view illustrating a right side of the shelf assembly illustrated in FIG. 2.
Figure 6:
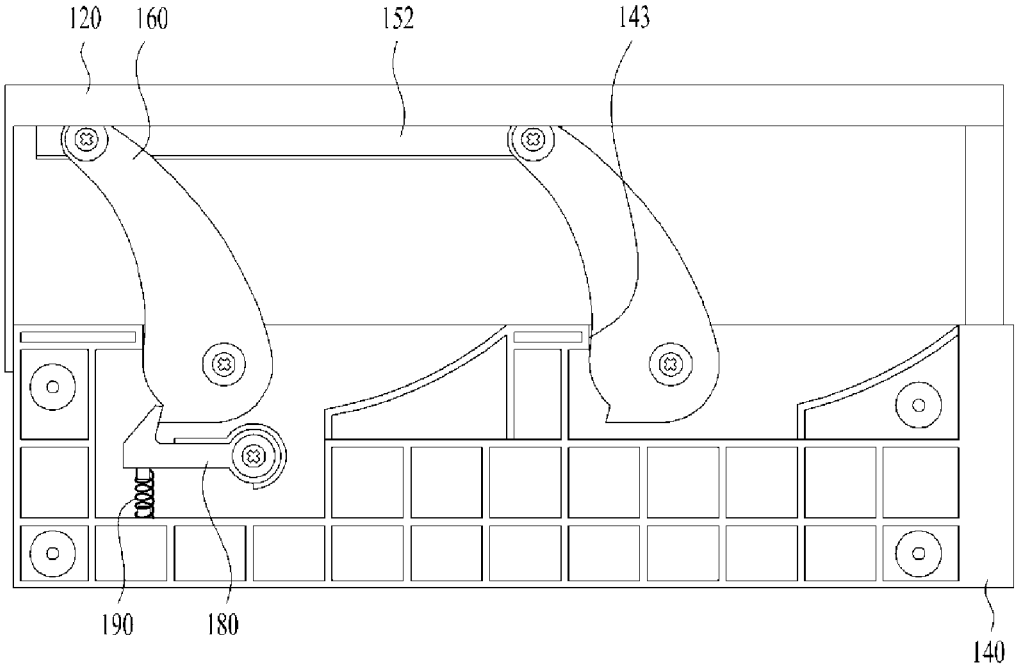
FIG. 6 is a right side view illustrating a raised state of the shelf in the shelf assembly of FIG. 5.

As illustrated in FIG. 5, when the cam member 160 is positioned at a lowered position, the convex rear surface of the cam member 160 is supported by the first support portion 142, which has the same curved shape as the convex rear surface. As illustrated in FIG. 6, when the cam member 160 is positioned at a raised position, the second support portion 143 contacts the concave front surface of the cam member 160 and supports the cam member 160, to prevent the cam member 160 from further pivoting in a forward direction.

In addition, as illustrated in FIG. 6, the second support portion 143 supports the cam member 160 when the cam member 160 is positioned at a raised position such that the second pivotal pin 165 of the cam member 160 connected to the corresponding extension portion 152 is positioned forward of a vertical line passing through the first pivotal pin 164 of the cam member 160 mounted to the corresponding guide member 140.

When the shelf 120 is positioned at a raised position, the cam member 160 is urged to pivot in a counterclockwise direction because an upper end of the cam member 160 is pressed downwards by the shelf 120, as illustrated in FIG. 6. However, the second support portion 143 supports the cam member 160, to prevent the cam member 160 from further pivoting.

In order to lower the shelf 120 in this state, the second pivotal pin 165 should be further raised to pass the vertical line passing through the first pivotal pin 164. For this reason, the shelf 120 is prevented from being easily lowered from the raised position thereof. Accordingly, the shelf 120 does not easily fall from the raised position thereof even when the user unintentionally touches the shelf 120 or impact is applied to the shelf 120.

Again referring to FIG. 3, each guide member 140 may include a vertical guide groove 145 formed at an inner surface of the guide member 140 while having a concave shape. Each side wall 130 may include a guide rib 132 inserted into the vertical guide groove 145 of the corresponding guide member 140, to be vertically slidable. The guide groove 145 may be provided at a rear end of the inner surface of the guide member 140 while having a "U"-shaped horizontal cross-section.

Corresponding to the guide groove 145, the guide rib 132 may be provided at a rear end of the outer surface of the side wall 130 while having a "U"-shaped horizontal cross-section. One guide groove 145 may be formed at the rear end of the guide member 140, one guide rib 132 may be formed at the rear end of the side wall 130, and a front end of the side wall 130 is formed to cover a front surface of the guide member 140. Front surfaces of the shelf 120, side walls 130, and guide members 140 may be exposed to the user under the condition that these elements are mounted in the refrigerating compartment 20, for use thereof.

If the above-described guide groove 145 and guide rib 132 are also formed at front ends of the corresponding elements, foreign matter may become trapped between the guide groove 145 and the guide rib 132, or a finger may be held between the guide groove 145 and the guide rib 132. In the latter case, the user may be injured. Accordingly, the front end of the side wall 130 may be formed to cover a front surface of the guide member 140, as illustrated in FIG. 2.

As illustrated in FIGS. 2 to 6, the refrigerator of the present disclosure may further include locking lever devices 180 each pivotably mounted to a corresponding one of the guide members 140, to be selectively engaged with an engagement portion or notch 168 provided at one side of a corresponding one of the cam members 160 in order to selectively limit pivotal movement of the corresponding cam member 160.

Each locking lever device 180 may be disposed beneath one of the cam members 160 in a corresponding one of the guide members 140. In particular, the locking lever device 180 may be disposed beneath a front one of the cam members 160.

The locking lever device 180 may include a locking lever 180 pivotably mounted to a pivotal pin 148 provided at the corresponding guide member 140 beneath the cam member 160, a hook 187 provided at an end of the locking lever 180 opposite to the pivotal pin 148, and an elastic member 190 mounted between the locking lever 180 and the guide member 140, to return the locking lever 180 to an original position thereof after pivoting.

Reference numeral "180" designating the locking lever device is also used to designate the locking lever. Mounting of the locking lever 180 may be achieved by fitting a pivotal pin hole 182 provided at one end of the locking lever 180 around the pivotal pin 148 provided at the outer surface of the guide member 140 while taking the form of a protrusion.

The hook 187, which is formed at the end of the locking lever 180 opposite to the pivotal pin 148, to be selectively engaged with the engagement portion 168 of the cam member 160, may have a bent structure. The engagement portion 168 may be provided at a portion of the cam member 160 beneath the first pin hole 164 while taking the form of a surface inclined through a predetermined angle.

Corresponding to the engagement portion 168, a contact surface 186 inclined through a predetermined angle may be provided at a surface portion of the hook 187 facing the pivotal pin hole 182. In a state in which the contact surface 186 of the hook 187 is engaged with the engagement portion 168 of the cam member 160, the cam member 160 cannot pivot to a lowered position thereof.

The elastic member 190 may be mounted between an elastic member mounting protrusion 147 provided at the guide member 140 and an elastic member mounting protrusion 189 provided at one side of the locking lever 180. The elastic member 190 is illustrated as being a coil spring. However, a torsion spring or a spring of another form may be used, so long as it can pivot the locking lever 180 toward the engagement portion 168 of the cam member 160.

Each locking lever device may further include a stopper 149 protruding from the outer surface of the corresponding guide member, to limit pivotal movement of the corresponding locking lever 180 in one direction. The stopper 149 is disposed above the locking lever 180 while extending longitudinally, to limit a maximally raised position of the locking lever 180. The stopper 149 may be formed to surround the pivotal pin 148 of the locking lever 180. When the locking lever 180 is urged to come into contact with the stopper 149 by the elastic member 190, the locking lever 180 may be horizontally disposed. The stopper 149 may support the locking lever 180, to maintain the locking lever 180 at a raised position thereof, irrespective of whether or not the hook 187 is engaged with the engagement portion 168 of the cam member 160.

Each locking lever device may further include an operating protrusion 184 provided at a side surface of the corresponding locking lever 180. In this case, the corresponding guide member 140 may include an operating hole 146 to receive the operating protrusion 184. The operating protrusion 184 is formed to protrude from the locking lever 180 toward the guide member 140. The operating protrusion 184 extends through the operating hole 146 provided at the guide member 140 and, as such, may vertically move as the locking lever 180 pivots. To this end, the operating hole 146 may tack the form of a vertically-extending slot having a greater diameter than the operating protrusion 184.

The operating protrusion 184 may further protrude inwards through the inner surface of the guide member 140, to allow the user to easily move the operating protrusion 184 downwards by a finger. In addition, each side wall 130 may include a groove 138 provided to cover the corresponding operating protrusion 184, which protrudes inwards from the inner surface of the corresponding guide member 140 after extending through the corresponding operating hole 146 when the side wall 130 is positioned at a lowered position thereof.

The side wall 130 moves downwards while contacting the inner surface of the guide member 140. During this movement, the lower end of the side wall 130 may interfere with the operating protrusion 184. To this end, the groove 138 may be formed at the lower end of the side wall 130, to correspond to the position and protruding length of the operating protrusion 184.

Figure 4:
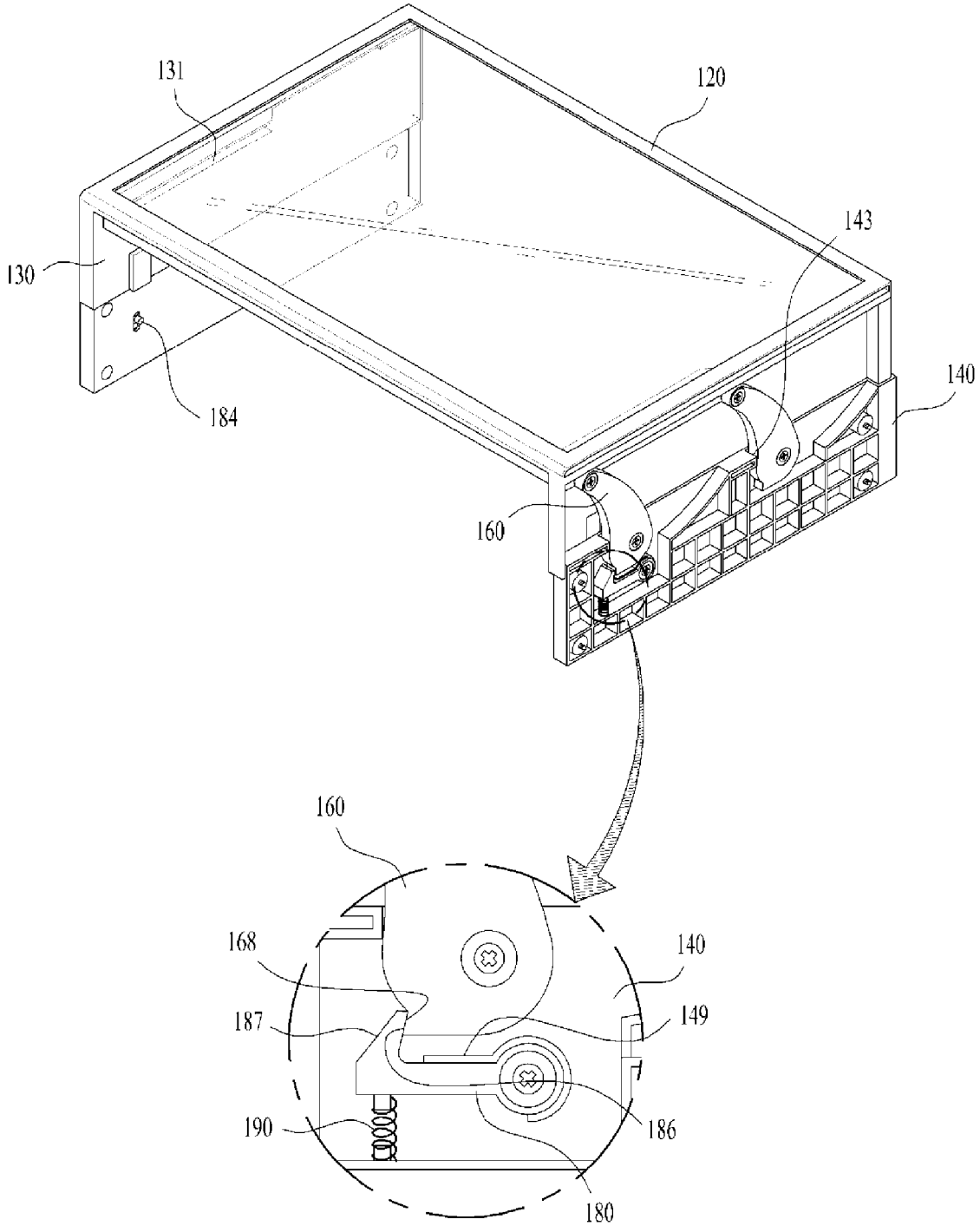
FIG. 4 is a perspective view illustrating a raised state of a shelf in the shelf assembly of FIG. 2.

As illustrated in FIG. 2, when the shelf 120 is positioned at a lowered position thereof, the operating protrusion 184 is received in the groove 138 and, as such, is hidden. On the other hand, as illustrated in FIG. 4, when the shelf 120 is positioned at a raised position thereof, the operating protrusion 184 is exposed to the inner surface of the guide member 140 in order to allow the user to pivot the corresponding locking lever 180 downwards.

As apparent from the present disclosure, the user may raise or lower the shelf 120 by one hand while maintaining the shelf 120 in a horizontal state by raising or lowering the cam members 160 provided in pairs at opposite sides of the guide members 140, using the single handle member 150 connecting the cam members 160 at opposite sides thereof.

In addition, in order to prevent the shelf 120 from unintentionally falling to a lowered position thereof, relative support positions of the first pin hole 164 and second pin hole 165 in each cam member 160 are appropriately arranged, and the cam member 160 is prevented from pivoting to a lowered position thereof unless a locked state of the cam member 160 is released in accordance with operation of the corresponding locking lever device.

A refrigerator may have a simple structure capable of easily achieving level adjustment of a shelf.

A refrigerator may have a shelf assembly operating structure capable of simultaneously vertically moving left and right sides of a shelf while maintaining the shelf in a horizontal state.

A refrigerator may have a safety device capable of preventing a shelf from unintentionally moving from an upper position to a lower position.

A refrigerator may include a cabinet defined with a storage chamber therein, and a shelf assembly mounted in the storage chamber, to be vertically movable, wherein the shelf assembly includes a pair of guide members respectively mounted to opposite side walls of the storage chamber, a shelf vertically movable while being guided by the guide members, a pair of side walls extending downwards from opposite lateral ends of the shelf and vertically movable while being guided by the guide members, respectively, a handle member having opposite ends mounted in a pair of guide slots formed through upper portions of the side walls, respectively, to be slidably guided by the guide slots in forward and rearward directions, two pairs of cam members pivotably mounted to corresponding ones of the guide members, to support the shelf, and a pair of extension portions pivotally connected to corresponding ones of the cam members while extending rearwards from the opposite ends of the handle member, respectively.

The two pairs of the cam members may include a pair of front cam members connected to opposite outer surfaces of the handle member, respectively, and a pair of rear cam members connected to outer surfaces of rear ends of the extension portions, respectively.

Each of the guide members may include a first support portion provided at an outer surface of the guide member, to support a corresponding one of the cam members in the guide member when the corresponding cam member is positioned at a lowered position thereof, and a second support portion provided at the outer surface of the guide member, to support the corresponding cam member when the corresponding cam member is positioned at a raised position thereof.

The second support portion may support the cam member when the cam member is positioned at the raised position such that a second pivotal pin of the cam member connected to a corresponding one of the extension portions is positioned forward of a vertical line passing through a first pivotal pin of the cam member mounted to the guide member.

Each of the guide members may include a vertical guide groove formed at an inner surface of the guide member while having a concave shape. Each of the side walls may include a guide rib inserted into the vertical guide groove of a corresponding one of the guide members, to be vertically slidable.

The refrigerator may further include locking lever devices each pivotably mounted to a corresponding one of the guide members, to be selectively engaged with an engagement portion provided at one side of a corresponding one of the cam members in order to selectively limit pivotal movement of the corresponding cam member.

Each of the locking lever devices may include a locking lever pivotably mounted to a pivotal pin provided at the corresponding guide member beneath the cam member, and a hook provided at an end of the locking lever opposite to the pivotal pin, to be selectively engaged with the engagement portion of the cam member.

The locking lever device may further include an elastic member mounted between the locking lever and the guide member, to return the locking lever toward a position at which the hook is engaged with the engagement portion.

The locking lever device may further include a stopper protruding from an outer surface of the guide member, to limit pivotal movement of the locking lever in one direction.

The locking lever device may further include an operating protrusion provided at a side surface of the locking lever, to protrude inwards from an inner surface of the guide member.

Each of the guide members may further include an operating hole for receiving the operating protrusion of the corresponding locking lever device, to allow the operating protrusion to move pivotally.

Each of the side walls may include a groove provided to cover the operating protrusion protruding inwards from the inner surface of the corresponding guide member after extending through the operating hole of the guide member when the side wall is positioned at a lowered position thereof.

The shelf may include a peripheral portion formed to be integrated with the side walls, and a shelf portion mounted to the peripheral portion inside the peripheral portion and made of a transparent material.

The guide members may be fastened to the opposite side walls of the storage chamber, respectively, to be fixed to the storage chamber.

The refrigerator may be easily manufactured because the structure for adjusting the level of the shelf is simple.

In addition, the user convenience is increased because the operating mechanism for level adjustment of the shelf is simple.

Furthermore, there is little or no formation of a dead space for allowing movement of the shelf because positions of the shelf in forward and rearward directions in raised and lowered states of the shelf are the same.

In addition, it may be possible to simultaneously vertically move left and right sides of the shelf by simply moving one handle member and, as such, the shelf may be moved while being maintained in a horizontal state.

In addition, it may be possible to prevent the shelf from unintentionally falling during use thereof under the condition that the shelf is positioned at a raised position.

A refrigerator may include a cabinet having a storage chamber therein; and at least one movable shelf configured to move vertically and provided in the storage chamber, wherein the movable shelf includes at least one flat panel, first and second lateral walls extending vertically from ends of the at least one flat panel, first and second support side walls configured for coupling to first and second walls of the storage chamber, the first support sidewall being configured for coupling to the first side wall of the storage chamber and a second support side wall being configured for coupling to the second side wall of the storage chamber, the first and second lateral walls configured to be guided in vertical movement by the first and second support side walls, respectively, at least one slot provided on at least one of the first support side wall or the second support side wall and extending in a horizontal direction, at least first one cam configured to pivot over a first side surface of at least one of the first support side wall or the second support side wall to move the at least one flat panel vertically, and a handle coupled to the at least one cam through the first slot, wherein a coupling of the handle and the at least one cam is at an opposite end of the at least one cam from a pivoting point of the at least one cam.

The at least one cam may include a first cam provided on the first side of the first support side wall and a second cam provided on the first side wall of the second support side wall, and the at least one slot includes a first slot provided on the first support side wall and a second slot provided on the second support side wall, wherein the handle extends from the first support side wall to the second side wall in a lateral direction, a first end of the handle being configured for coupling to the first cam and a second end of the handle being configured for coupling to the second cam. The handle may include a first extension extending from the first end and a second extension extending from the second end in the horizontal direction parallel to the first and second slots, the first cam being coupled to the first extension and the second cam being coupled to the second extension.

The at least one cam may further comprise a third cam provided on the first side of the first support side wall and a fourth cam provided on the first side wall of the second support side wall, the third and fourth cams being closer to a rear of the storage chamber than the first and second cams, respectively, and the first and third cams being coupled to the first extension and the second and fourth cams being coupled to the second extension of the handle. The first side surfaces of the first and second support side walls are outer surfaces facing the first and second walls of the storage chamber, and the first and second walls being opposing walls facing each other.

The movable shelf may further include a locking lever having a hook end, wherein the first cam includes a notch configured to engage the hook end of the locking lever when the at least one flat panel is vertically raised to a second position from a first position.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet defined with a storage chamber therein; and a shelf assembly mounted in the storage chamber, to be vertically movable, wherein the shelf assembly comprises a pair of guide members respectively mounted to opposite side walls of the storage chamber, a shelf vertically movable while being guided by the guide members, a pair of side walls extending downwards from opposite lateral ends of the shelf and vertically movable while being guided by the guide members, respectively, a handle member having opposite ends mounted in a pair of guide slots formed through upper portions of the side walls, respectively, to be slidably guided by the guide slots in forward and rearward directions, two pairs of cam members pivotably mounted to corresponding ones of the guide members, to support the shelf, and a pair of extension portions pivotally connected to corresponding ones of the cam members while extending rearwards from the opposite ends of the handle member, respectively.

2. The refrigerator according to claim 1, wherein the two pairs of cam members comprise:

a pair of front cam members connected to opposite outer surfaces of the handle member, respectively; and a pair of rear cam members connected to outer surfaces of rear ends of the extension portions, respectively.

3. The refrigerator according to claim 2, wherein each of the guide members comprises a first support portion provided at an outer surface of the guide member, to support a corresponding one of the cam members in the guide member when the corresponding cam member is positioned at a lowered position thereof, and a second support portion provided at the outer surface of the guide member, to support the corresponding cam member when the corresponding cam member is positioned at a raised position thereof.

4. The refrigerator according to claim 3, wherein the second support portion supports the cam member when the cam member is positioned at the raised position such that a second pivotal pin of the cam member connected to a corresponding one of the extension portions is positioned forward of a vertical line passing through a first pivotal pin of the cam member mounted to the guide member.

5. The refrigerator according to claim 1, wherein:

each of the guide members comprises a vertical guide groove formed at an inner surface of the guide member while having a concave shape; and each of the side walls comprises a guide rib inserted into the vertical guide groove of a corresponding one of the guide members, to be vertically slidable.

6. The refrigerator according to claim 1, further comprising:

locking lever devices each pivotably mounted to a corresponding one of the guide members, to be selectively engaged with an engagement portion provided at one side of a corresponding one of the cam members in order to selectively limit pivotal movement of the corresponding cam member.

7. The refrigerator according to claim 6, wherein each of the locking lever devices comprises:

a locking lever pivotably mounted to a pivotal pin provided at the corresponding guide member beneath the cam member; and a hook provided at an end of the locking lever opposite to the pivotal pin, to be selectively engaged with the engagement portion of the cam member.

8. The refrigerator according to claim 7, wherein the locking lever device further comprises:

an elastic member mounted between the locking lever and the guide member, to return the locking lever toward a position at which the hook is engaged with the engagement portion.

9. The refrigerator according to claim 8, wherein the locking lever device further comprises:

a stopper protruding from an outer surface of the guide member, to limit pivotal movement of the locking lever in one direction.

10. The refrigerator according to claim 7, wherein the locking lever device further comprises:

an operating protrusion provided at a side surface of the locking lever, to protrude inwards from an inner surface of the guide member.

11. The refrigerator according to claim 10, wherein each of the guide members further comprises an operating hole for receiving the operating protrusion of the corresponding locking lever device, to allow the operating protrusion to move pivotally.

12. The refrigerator according to claim 11, wherein each of the side walls comprises a groove provided to cover the operating protrusion protruding inwards from the inner surface of the corresponding guide member after extending through the operating hole of the guide member when the side wall is positioned at a lowered position thereof.

13. The refrigerator according to claim 1, wherein the shelf comprises:

a peripheral portion formed to be integrated with the side walls; and a shelf portion mounted to the peripheral portion inside the peripheral portion and made of a transparent material.

14. The refrigerator according to claim 1, wherein the guide members are fastened to the opposite side walls of the storage chamber, respectively, to be fixed to the storage chamber.

15. A refrigerator comprising:

a cabinet having a storage chamber therein; and at least one movable shelf configured to move vertically and provided in the storage chamber, wherein the movable shelf includes at least one flat panel, first and second lateral walls extending vertically from ends of the at least one flat panel, first and second support side walls configured for coupling to first and second side walls of the storage chamber, the first support side wall being configured for coupling to the first side wall of the storage chamber and a second support side wall being configured for coupling to the second side wall of the storage chamber, the first and second lateral walls configured to be guided in vertical movement by the first and second support side walls, respectively, at least one slot provided on at least one of the first lateral wall or the second lateral wall and extending in a horizontal direction, at least one cam configured to pivot over at least one of a first side surface of the first support side wall or a first side surface of the second support side wall to move the at least one flat panel vertically, and a handle coupled to the at least one cam through the first slot, wherein a coupling of the handle and the at least one cam is at an opposite end of the at least one cam from a pivoting point of the at least one cam, wherein the at least one cam includes a first cam provided on the first side surface of the first support side wall and a second cam provided on the first side surface of the second support side wall, the at least one slot includes a first slot provided on the first lateral wall and a second slot provided on the second lateral wall, and the handle extends between the first lateral wall and the second lateral wall in a lateral direction, a first end of the handle being configured for coupling to the first cam and a second end of the handle being configured for coupling to the second cam.

16. The refrigerator of claim 15, wherein the handle includes a first extension extending from the first end and a second extension extending from the second end in the horizontal direction parallel to the first and second slots, the first cam being coupled to the first extension and the second cam being coupled to the second extension.

17. The refrigerator of claim 16, wherein the at least one cam further comprises a third cam provided on the first side of the first support side wall and a fourth cam provided on the first side wall of the second support side wall, the third and fourth cams being closer to a rear of the storage chamber than the first and second cams, respectively, and the first and third cams being coupled to the first extension and the second and fourth cams being coupled to the second extension of the handle.

18. The refrigerator of claim 15, wherein the first side surfaces of the first and second support side walls are outer surfaces facing the first and second walls of the storage chamber, and the first and second walls being opposing walls facing each other.

19. The refrigerator of claim 15, further comprising a locking lever having a hook end, wherein the first cam includes a notch configured to engage the hook end of the locking lever when the at least one flat panel is vertically raised to a second position from a first position.

* * * * *